US005582550A

United States Patent [19]

Foley

[11] Patent Number: 5,582,550

[45] Date of Patent: Dec. 10, 1996

[54] AUTOMATICALLY-SCORING MINI-GOLF GAME

[76] Inventor: Thomas P. Foley, 518 Red Oak Dr., Severna Park, Md. 21146

[21] Appl. No.: 587,023

[22] Filed: Jan. 16, 1996

Related U.S. Application Data

[63] Continuation-in-part of Ser. No. 408,044, Mar. 21, 1995, Pat. No. 5,487,542.

[51] Int. Cl.[6] ..... A63B 69/36; A63B 67/02

[52] U.S. Cl. ..... 473/153; 473/155; 473/353; 473/176

[58] Field of Search ..... 473/153, 155, 473/176, 353

[56] References Cited

U.S. PATENT DOCUMENTS

| | | | |
|---|---|---|---|
| 1,840,406 | 11/1930 | McEvoy | 273/162 A |
| 3,104,879 | 7/1961 | Jetton | 273/176 |
| 3,380,305 | 4/1968 | Charell | 273/186.2 X |
| 3,782,730 | 1/1974 | Horchler | 473/353 |
| 3,806,131 | 4/1974 | Evans | 273/186.2 |
| 3,891,221 | 6/1975 | Gordon | 273/177 R |
| 4,283,057 | 8/1981 | Ragan | 273/186.2 |
| 4,940,236 | 7/1990 | Allen | 273/184 R X |
| 4,991,850 | 2/1991 | Wilhlem | 273/186 A |
| 5,056,106 | 10/1991 | Wang et al. | 273/213 X |
| 5,127,044 | 6/1992 | Bonito et al. | 273/176 L X |
| 5,132,622 | 7/1992 | Valentino | 273/213 X |
| 5,354,052 | 10/1994 | Nicholls et al. | 273/34 R |
| 5,370,389 | 12/1994 | Reising | 273/213 X |
| 5,395,116 | 3/1995 | Blaakman | 273/186.2 X |
| 5,423,549 | 6/1995 | Englmeier | 473/353 |
| 5,487,542 | 1/1996 | Foley | 473/353 |
| 5,513,841 | 5/1996 | Takagi | 473/153 X |

*Primary Examiner*—George J. Marlo
*Attorney, Agent, or Firm*—Browdy and Neimark

[57] ABSTRACT

A golf game uses radio signals from golf balls to signal to a central computer for automatic score-keeping by the computer. Sensors in each hole also send signals to the computer on the completion of each hole play for each golfer. The golf balls are distinguishable by the computer according to their radio frequencies or digital or other signal processing and coding encoding. The golf balls transmit struck by special golf clubs which incorporate magnets; the balls include magnetic or other corresponding sensors. Each player, upon starting the game, inputs his/her name or initials which action identifies the specific ball he/she has been assigned use on the course. Scores are reported optionally at each hole, and a final score is reported by the computer at the conclusion of play.

20 Claims, 6 Drawing Sheets

FIG. 5A

WELCOME!!

- PLEASE TYPE YOUR INITIALS AND CLUB NUMBER AND "ENTER"

INITIAL CLUB#

17

FIG. 5B

WELCOME!!

- PLEASE TYPE YOUR INITIALS AND CLUB NUMBER AND "ENTER"

| INITIAL | CLUB# |
|---|---|
| TPF | 64 |
| RTF | 114 |
| ACP | 81 |
| BJF | 92 |

- START PLAY NOW. EACH TIME YOU TOUCH THE BALL WITH THE PUTTER, A STROKE WILL REGISTER AUTOMATICALLY.

GOOD LUCK!

17

FIG. 5C

| PLAYER | SCORE |
|---|---|
| TPF | 3 |
| RTF | 1 |
| ACP | 2 |
| BJF | 2 |

PLEASE PROCEED TO NEXT HOLE

21 THRU 29

FIG. 5D

| PLAYER | | TPF | RTF | ACP | BJF |
|---|---|---|---|---|---|
| HOLE | 1 | 3 | 1 | 2 | 2 |
| | 2 | 1 | 2 | 1 | 2 |
| | 3 | 2 | 2 | 2 | 1 |
| | - | | | | |
| | - | | | | |
| | N | 2 | 1 | 1 | 1 |
| TOTAL SCORE | | 39 | 36 | 34 | 33 |

30

AUTOMATICALLY-SCORING MINI-GOLF GAME

CROSS-REFERENCE TO RELATED APPLICATION

This is a CIP of Application Ser. No. 08/408,044, filed Mar. 21, 1995, now U.S. Pat. No. 5,487,541 the contents of which are incorporated herein by reference.

BACKGROUND OF THE INVENTION

1. Field of the Invention

The present invention relates to games having a plurality of balls, a plurality of clubs for striking the balls, and holes into which balls may fall, and more particularly to such games with automatic scoring devices.

2. Description of the Related Art

Mini-golf has been in use for many years, with courses of a few to 18 or 36 holes. Scoring is typically done manually by each player, sometimes resulting in arguments between players as to whether the proper score has been written by the player. Players also may lose scorecards or pencils, or may not wish to carry them. There is a need for automatic scoring of each player at each hole, and for a central means for reporting scores to the players.

SUMMARY OF THE INVENTION

Accordingly, the present invention has an object, among others, to overcome deficiencies in the prior art.

The invention relates to, for example, a mini-golf game, although the invention will work as well in any golf game. The invention provides that at the start of play of a golf game, each player keys into a computer his/her name or initials. All golf clubs used for play are coded magnetically or otherwise, to cause a response when striking the ball, which contains sensors to register when a stroke has been taken. The sensors in the ball are connected to a low-power radio transmitter also contained in the ball which signals a central receiver in a manner unique to each ball, which receiver may be located in proximity to the central computer. Thus, the computer is capable of receiving and storing the number of strokes taken by the player. Sensors in each putting hole, either optical, magnetic, weight-actuated, or otherwise, also alert the computer that a ball being played towards that hole has entered the hole, allowing the computer to determine that the player last striking a ball has completed that hole. Displays of the number of strokes taken by each player are located at each hole area, or at a central location, and a final display of the sum of all strokes taken during play is located at the final hole, or at a central location. Also located with the final display is a printer to print out the score, total as well as hole-by-hole, for each player.

BRIEF DESCRIPTION OF THE DRAWINGS

The above and other objects and the nature and advantages of the present invention will become more apparent from the following detailed description of an embodiment taken in conjunction with drawings, wherein:

FIGS. 5A, 5B, 5C and 5D depict the various displayed information used in the system.

DETAILED DESCRIPTION OF THE PREFERRED EMBODIMENT

Figure 1:
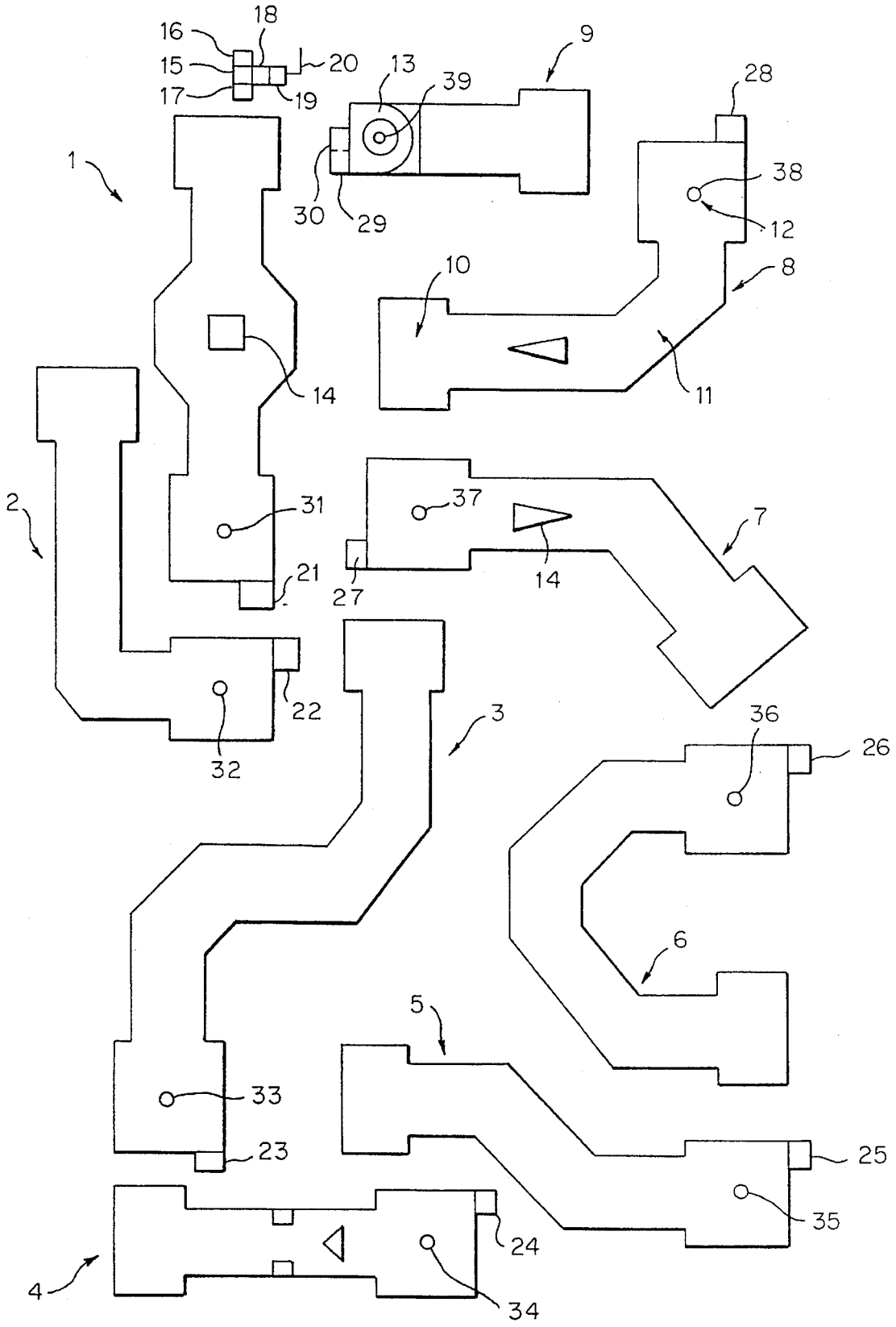
FIG. 1 is a plan view of the mini-golf course according to the invention.

A plan view of the nine-hole mini-golf course is shown in FIG. 1. Each of the golf holes 1 through 9 contain a tee area 10, a fairway 11, and a golf hole 12. The final hole usually contains a target 13, which retains the golf balls for further use. Fairways are typically distorted and/or contain obstructions 14, which test the skill of the players. A computer 15, with its keyboard 16, display 17, and printer 18 is located adjacent to the tee of the first hole 1. Also collocated with the computer 15 is a receiver 19, wired via cable to an antenna 20 located under the carpet or frame of each mini-golf fairway, the function of which will be described below. Adjacent to each golf hole 1 through 9 are displays 21 through 29, wired to computer 15 to display each player's golf score for that hole. A final display 30 gives the total score for each player in their foursome. Golf holes 31 through 39 each contain sensors which are wired to computer 15 to signify the presence of a golf ball in that hole.

Figure 2A:
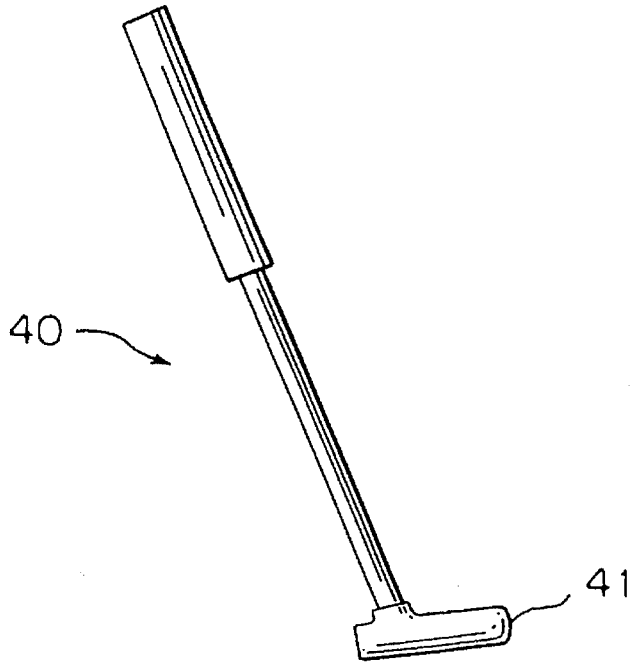
FIGS. 2A and 2B illustrate one method of coding the golf clubs used in the invention.
Figure 2B:
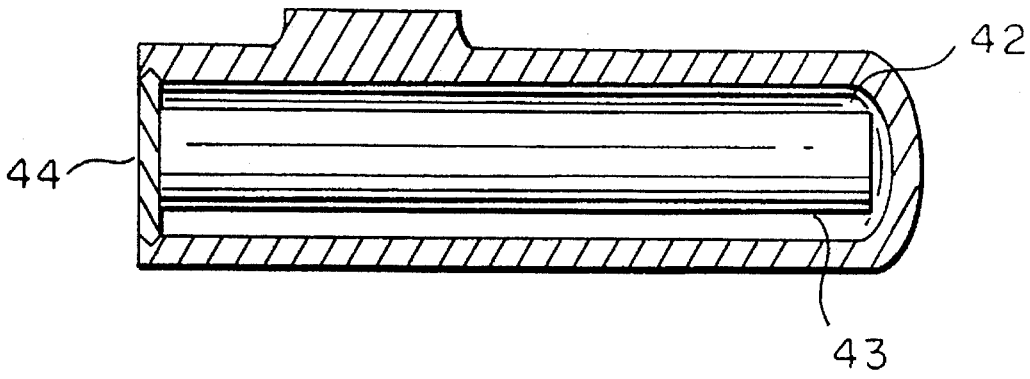

Prior to the start of play, each player of a mini-golf foursome (or less) is provided with a golf club constructed to emanate a weak magnetic field around its clubface area. One method of construction of such magnetically-responsive golf clubs is given in FIGS. 2A and 2B. In FIG. 2A, a typical golf club 40 is used as a putter. A cross section of the putting head 41 is given in FIG. 2B, showing a drilled cavity 42, into which is placed a permanent rod magnet 43. The assembly is sealed with a plug 44. The outer material of the putting head 41 is aluminum or hard rubber, or any other non-ferrous material, with sufficient wall thickness to prevent wall collapse during normal use, while thin enough to allow the magnetic field of the club to cause a reaction in the ball.

Each player also receives a Wolf ball containing a transmitter, whose coding is unique to each ball. For a 9-hole mini-golf course, for example, at least 36 such balls would be required if a foursome were playing on each hole. For an 18-hole course, at least 72 such balls would be required.

Figure 3A:
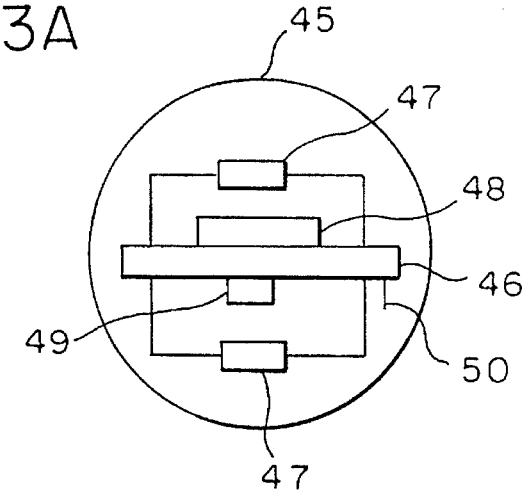
FIGS. 3A and 3B show one method of detecting strokes of the ball, for transmission to a central receiver and computer.
Figure 3B:
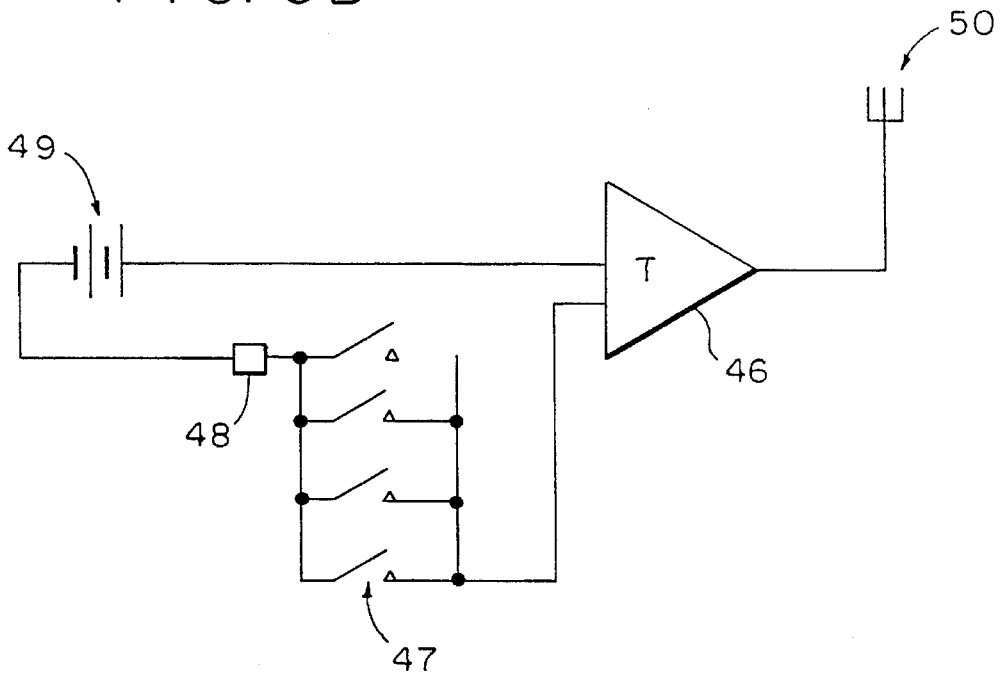

The construction of the magnetically-activated golf ball transmitter is given in FIGS. 3A and 3B. The ball is constructed as two halves of a hollow plastic golf ball, into which are placed the transmitter components. FIG. 3A identifies the parts of the golf ball 45 as the low-power transmitter 46, magnetic reed sensors 47, motion sensor 48, battery 49, and antenna 50. In FIG. 3B, a schematic diagram of the ball components is given. The transmitter 46 is energized through any of a set of magnetically-actuated sensing switches 47, connected in parallel, then further connected in series with a motion sensor 48, and battery 49 to transmit a coded pulse through antenna 50.

After transmitter assembly, both halves of the golf ball are filled with a non-conducting material to protect the parts against shock and to give the ball the proper weight. The two halves are then cemented together and painted. A symbol or number may then be imprinted on the completed ball to identify its unique coding. External connections for recharging the battery may also be included.

Each player receives a golf ball containing a uniquely-coded transmitter, dispensed when the player's name or initials is entered into the system. The ball is dispensed past a magnet, thus triggering a transmission. The central receiver at the computer site reads the unique coding of the ball and relays this information to the computer to associate each ball with its respective entered name or initials. By this association, the system will have the ability to keep an accurate stroke score for each ball, hence for each player.

Figure 4A:
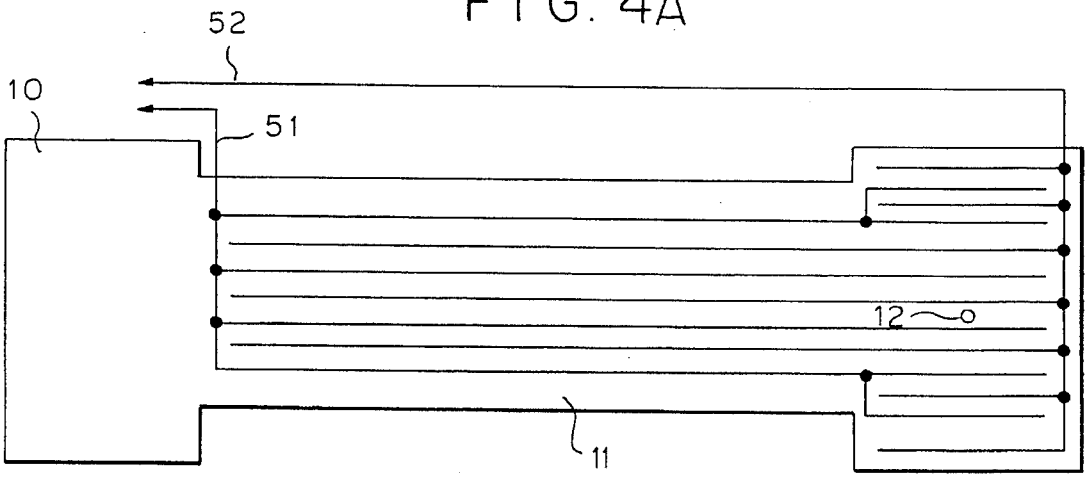
FIGS. 4A, 4B and 4C show an arrangement that may be used as antennae to detect such transmissions and for sensing the completion of play at each hole.
Figure 4B:
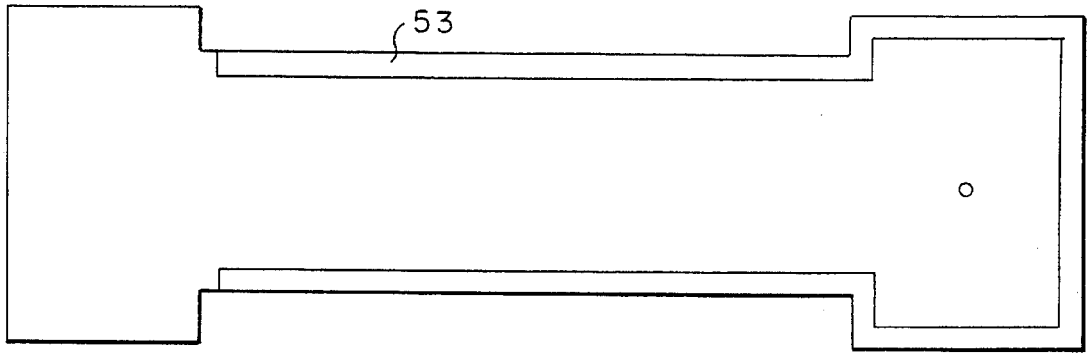
Figure 4C:
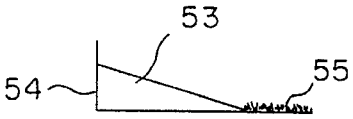
Figure 4D:
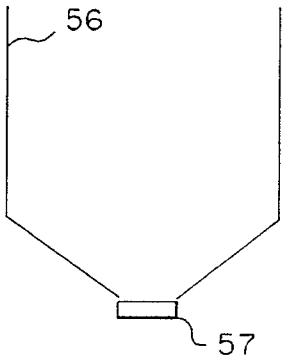
FIG. 4D shows the construction of each hole.

FIGS. 4A–4D describe the golf hole receiving antenna and ball-in-hole apparatus. In FIG. 4A, a plan view of the underside of the golf hole carpet or frame, shows the tee area 10, fairway 11, and hole 12. The antenna 51 and ground plane 52 are wired under the carpet or frame to the very low-power transmission from golf balls. Such transmissions are kept at very low power to prevent "collision" with signals from other golf holes, which may confuse the receiver. As FIGS. 4B and 4C show, an alternative antenna is wired under "bevels" 53, installed at the sides of golf holes. This alternative requires somewhat higher power transmissions, but has the added advantage of easier installation on existing mini-golf courses. The "bevels" 53 also provide the further advantage of preventing golf balls from coming to rest against the sides of mini-golf fairways. It is common practice to use the club to move balls that come to rest against a side wall several inches away from the side so that they can be putted properly. Such action would cause a false stroke to be registered in this system; the "bevels" 53 also eliminate the need for such false strokes. FIG. 4C shows a cross-section of the bevel 53, mounted between the golf hole side 54 and the synthetic grass 55 of the fairway.

In addition to the magnetized golf club and ball transmitter described above, each hole is constructed as shown in FIG. 4D. The body of each golf hole 56 is built out of plastic or any other non-magnetic material. At the base of each hole, a weight-activated switch 57 is located to sense the presence of a golf ball. Alternatively, a permanent bar magnet may be used instead of the weight-activated switch 57 to cause a second transmission, which can be interpreted by the system as "ball-in-hole". A further alternative uses a switch 57 which responds with up to four outputs, depending on weight. Thus, if players do not remove golf balls from holes until several or all of a foursome have completed play, the switch 57 can read each additional "ball-in-hole" activity separately.

As each player in a foursome (or less) approach the first hole's tee area, the computer display 17 is as shown in FIG. 5A , which requests each player to enter their initials via the keyboard 16. A ball is dispensed after initials are entered, and the ball's coding is identified to that player. When all players have entered their data, the display is as shown in FIG. 5B, informing that group to begin play. The computer 15 is programmed to start scoring for each entered player until a hole sensing switch 57 is closed, which will alert the computer 15 that the player whose last stroke was received on that hole has completed that hole. When all players of a group complete each hole 1 through 9 successively, the displays 21 through 29 at each hole present the display given in FIG. 5C. Other congratulatory display messages, such as "NICE SHOT", "BIRDIE", "WOW", etc., with accompanying sounds may also be added to increase player's enjoyment of the game. When the final hole 9 has been completed by all players in a group, the final display 30 presents the information of each player's score at each hole, and total score, as shown in FIG. 5D. This information is also printed for players retention by printer 18.

Figure 6:
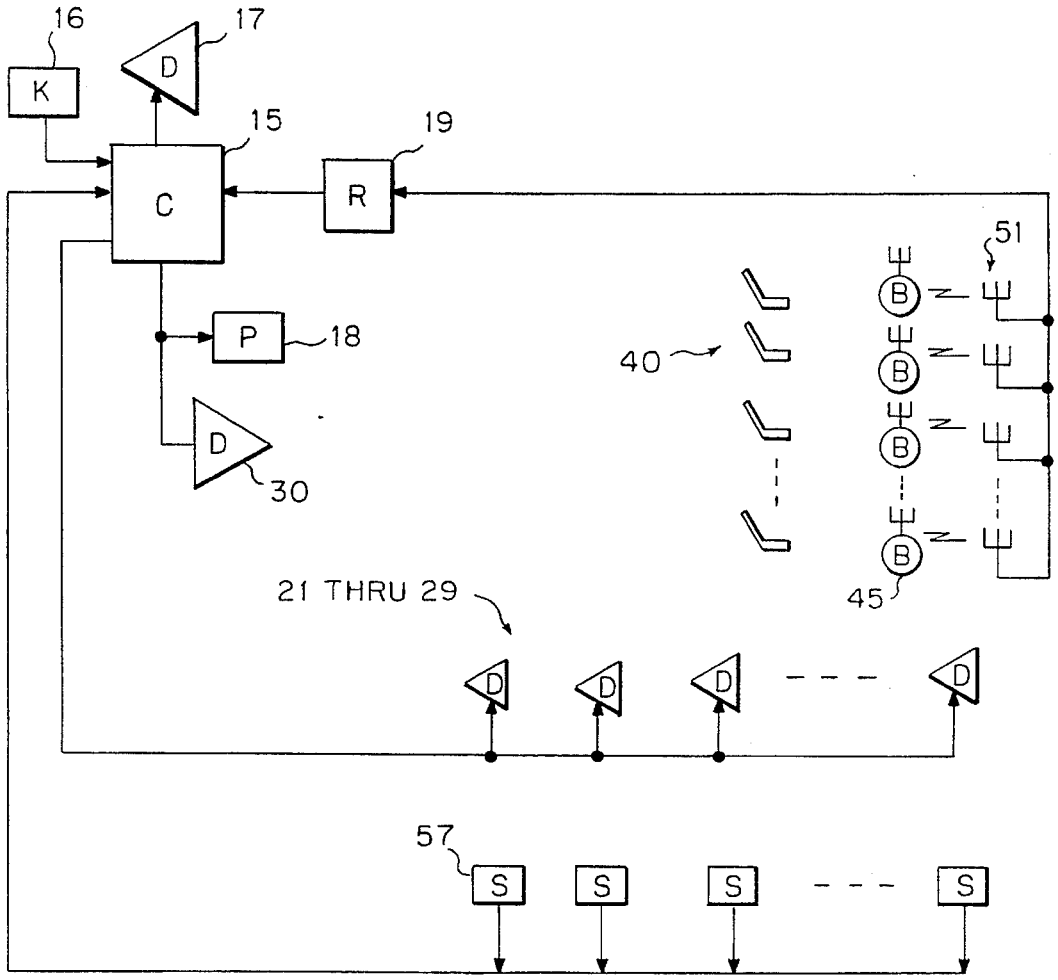
FIG. 6 illustrates a block diagram of the entire automatic-scoring golf course.

A block diagram of components of the Automatically-Scoring Mini-Golf Game is given in FIG. 6. Computer 15 receives inputs from keyboard 16, receiver(s) 19, and each of the hole sensors 57. Golf balls 45 sense strokes by golf clubs 40 and transmit such information via antennae 51, each separately coded by frequency, digital code, or other multiplexing means, to receiver(s) 19 for storage by computer 15, and later scoring use. Computer outputs are to the entry display 17, intermediate hole displays 21 through 29, final display 30, and printer 18.

The foregoing description of the specific embodiments will so fully reveal the general nature of the invention that others can, by applying current knowledge, readily modify, and/or adapt for various applications such specific embodiments, without departing from the generic concepts, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. In a game for players, of the type having a plurality of balls, a plurality of clubs for striking the balls, and a plurality of holes into which the balls may fall, and where scores are maintained, the improvement comprising:

a ball-strike sensor associated with each respective ball, a transmitter associated with each respective ball, the transmitter being coupled to the ball-strike sensor of the respective ball for emitting a respective signal upon being struck by one of the clubs, the signal being unique to the respective ball, and distinguishable from signals of all others of the balls;

receiver means for receiving the signals, the receiver means including a receiving antenna and a signal identifying means for determining which of the balls has been struck;

processing means for calculating and keeping scores, the processing means being coupled to the receiver means;

ball-in-hole sensors, coupled to the processing means, for reporting presence of the ball in each of the holes; and score-displaying means, coupled to the processing means, for selectively exhibiting a score of the respective ball.

2. The improvement according to claim 1, wherein the ball-strike sensor includes a means for distinguishing club contact from other contacts with objects other than one of the clubs.

3. The improvement according to claim 2, wherein the club includes a means for generating a permanent magnetic field and the ball-strike sensor includes a magnetic sensor responsive to the magnetic field, and wherein the ball sends the signal to the processing means only when the ball is struck.

4. The improvement according to claim 2, wherein the ball-strike sensor includes selectively a motion sensor and a magnetic sensor.

5. The improvement according to claim 2, wherein the club includes magnetic properties, the ball-strike sensor includes a motion sensor, and the ball-strike sensor includes a magnetic sensor responsive to the magnetic properties of the club.

6. The improvement according to claim 2, further including a plurality of the ball, and wherein each one of the balls includes a unique electronic identification, and the processing means includes means for reading the electronic identification of each one of the balls.

7. The improvement according to claim 1, wherein the receiving antenna is located in or under the fairway of the golf hole.

8. The improvement according to claim 1, wherein the balls transmit signals relatable to respective unique identifying ball indicia observable by the players and the score displaying means selectively shows the indicia when reporting scores.

9. The improvement according to claim 1, wherein the score-displaying means includes a plurality of hole displays, each of the hole displays being located adjacent a respective one of the holes.

10. The improvement according to claim 1, wherein the score-displaying means includes a printer for making a hard copy of a final score.

11. The improvement according to claim 1, wherein the score-displaying means includes an input device and a confirmation display of player names or initials.

12. The improvement according to claim 1, wherein the score-displaying means provides information including player names or initials, order of play, hole scores, hole-in-one announcements, instructions, and final scores.

13. The improvement according to claim 1, wherein the score-displaying means includes selectively voice announcements, audible alarms, and lights.

14. The improvement according to claim 1, wherein the receiving antenna is placed under a fairway carpet of the golf hole.

15. The improvement according to claim 1, wherein the receiving antenna is placed along vertical sides of the golf hole.

16. The improvement according to claim 1, including a bevel along each vertical side of a mini golf hole, which prevents balls from coming to rest against the vertical side, thereby facilitating a normal stroke without moving the ball.

17. The improvement according to claim 1, wherein signals are distinguishable selectively by being transmitted on various radio frequencies, incorporating various different digital codes, digital compression, and selectively phase coding and other signal processing methods.

18. The improvement according to claim 1, wherein the signal is a low power signal receivable only adjacent a location where scores are registered, and is not receivable at other game locations where the signal may interfere with other player's signals.

19. In a game using a plurality of clubs for striking a plurality of balls, the improvement comprising:

a ball-strike sensor associated with each respective ball;

a transmitter associated with each respective ball, the transmitter being electrically coupled to the ball-strike sensor of the respective ball for emitting an electrical signal upon the club striking the ball, the signal being unique to the respective ball and distinguishable from signals of all others of the balls, whereby any of the plurality of balls may be identified upon being struck by a club.

20. The improvement according to claim 19, wherein:

the club generates a field, and the ball-strike sensor includes, for distinguishing ball-club contact from other contacts with objects other than the club, selectively a motion sensor, a force sensor, and a field sensor.

* * * * *